US005135321A

United States Patent [19]

Olsen et al.

[11] Patent Number: 5,135,321

[45] Date of Patent: Aug. 4, 1992

[54] UNIFIED PAPER PATH PRINTER WITH AUTOMATIC PARKING FEATURE

[75] Inventors: Allan G. Olsen, Camas; Tod S. Heiles, Vancouver, both of Wash.

[73] Assignee: Hewlett-Packard Company, Palo Alto, Calif.

[21] Appl. No.: 582,817

[22] Filed: Sep. 12, 1990

Related U.S. Application Data

[63] Continuation of Ser. No. 457,435, Dec. 27, 1989, abandoned, which is a continuation of Ser. No. 255,933, Oct. 11, 1988, abandoned, which is a continuation of Ser. No. 56,094, May 29, 1987, Pat. No. 4,808,019.

[51] Int. Cl.[5] ..... B41J 11/50

[52] U.S. Cl. ..... 400/605; 400/283; 400/582; 400/624; 400/636; 400/639.1

[58] Field of Search ..... 400/283, 314, 611, 582, 400/584, 624, 625, 605, 607, 608, 609, 636.1, 629, 613.1, 639.1

[56] References Cited

U.S. PATENT DOCUMENTS

| | | | |
|---|---|---|---|
| 4,390,296 | 6/1983 | Siegenthaler | 400/608 |
| 4,425,047 | 1/1984 | Narushima | 400/608 |
| 4,452,543 | 6/1984 | Aduisson | 400/625 |
| 4,518,271 | 5/1985 | Hirata | 400/636.1 |
| 4,581,618 | 4/1986 | Watanabe | 400/636.1 |
| 4,594,013 | 2/1986 | Costa | 400/625 |
| 4,657,420 | 4/1987 | Kondo | 400/625 |
| 4,667,947 | 5/1987 | Costa | 400/625 |
| 4,687,362 | 8/1987 | Runzi | 400/629 |
| 4,688,957 | 8/1987 | Prevignano | 400/613.1 |
| 4,707,159 | 11/1987 | Hirano | 400/639.1 |
| 4,717,274 | 1/1988 | Kimura | 400/636.1 |
| 4,808,019 | 2/1989 | Olson et al. | 400/636.1 |

*Primary Examiner*—Eugene H. Eickholt

[57] ABSTRACT

A printer is disclosed having an improved paper feed mechanism. The improved paper feed system has a reduced cost and accepts a wide variety of paper types including continous forms and single cut sheets fed both by hand and from a paper tray. Furthermore, the printer is capable of switching from one paper source to another without requiring the operator to unload and reload paper. The mechanism operates with only two motors and no solenoids. Control over the paper path is maintained by employing the carriage to select the paper path and lift the ball. The printer also has a novel paper sensor.

4 Claims, 11 Drawing Sheets

UNIFIED PAPER PATH PRINTER WITH AUTOMATIC PARKING FEATURE

CROSS-REFERENCE TO RELATED APPLICATIONS

This application is a continuation of application Ser. No. 07/457,435, filed Dec. 27, 1989, now abandoned, which in turn is a continuation application of the copending application Ser. No. 255,933 filed on Oct. 11, 1988, now abandoned which is a continuation of the patent application Ser. No. 56,094, filed on May 29, 1987, now issued U.S. Pat. No. 4,808,019.

BACKGROUND

1. Field of Invention

This invention relates to the field of printing, and more particularly to a simplified mechanism for positioning and moving paper through a serial character printer. In particular, this mechanism is capable of accepting continuous forms and hand and paper tray fed cut sheets of paper alternatively without having to unload and reload the printer.

2. Description of the Prior Art

Printers may be classified by the rate and technique used to print on the paper. Of particular interest due to their low cost to both acquire and operate are serial character printers. These printers typically print a single character at a time using an impact, usually a dot matrix impact, ink jet or thermal technique.

These printers have two key subsystems, the paper feed subsystem and the printing mechanism. The essential aspect of such printers being their low cost, attention must be paid to the cost of each subsystem.

Low cost paper feed systems have been developed in the past. However, these prior art systems tend to be optimized for one type of paper, either hand fed sheet or continuous forms. Although these system may be adapted to accept another type of paper, the adapted paper feed system operates with less than optimum performance.

These prior art paper feed systems add motors and solenoids to perform the movement required to handle the new type of paper. Additional motors and solenoids drive up the cost of the printer. Also, they usually require the user to remove and reload the paper each time the type of paper is changed. They also increase the maintenance required to keep the printer operating.

SUMMARY

In accordance with the preferred embodiment of the present invention, an improved paper feed system is disclosed having a reduced cost and accepting a wide variety of paper types. The printer handles each type of paper efficiently and reliably.

The preferred embodiment of the present invention comprises a frame; a platen rotatably mounted in the frame; a paper sensor; a carriage having a print head; carriage drive means for movably mounting the carriage in the printer and moving the carriage parallel to the platen from a starting to an ending print position; a sprocket drive mounted in the frame; clutch means for engaging and disengaging the sprocket drive from the platen drive means; a bail having a first and second position; a bail lift means for moving the bail between the first and second position; platen drive means for advancing the paper around the platen; and control means for controlling the carriage drive means, the clutch means, the bail lift means and the platen drive means and responsive to the paper sensor. A single paper sensor is employed for detecting paper fed from any paper path.

The primary object of the present invention, therefore, is to provide a low cost and very reliable paper feed system.

Another object of the present invention is to accept a variety of paper, including cut sheets and continuous forms, without adding solenoids or expensive motors.

A further objective of the present invention is to permit the type of paper being used in the printer to be changed without the user having to unload the current paper and load the new type of paper.

DESCRIPTION OF THE PREFERRED EMBODIMENT

Figure 1:
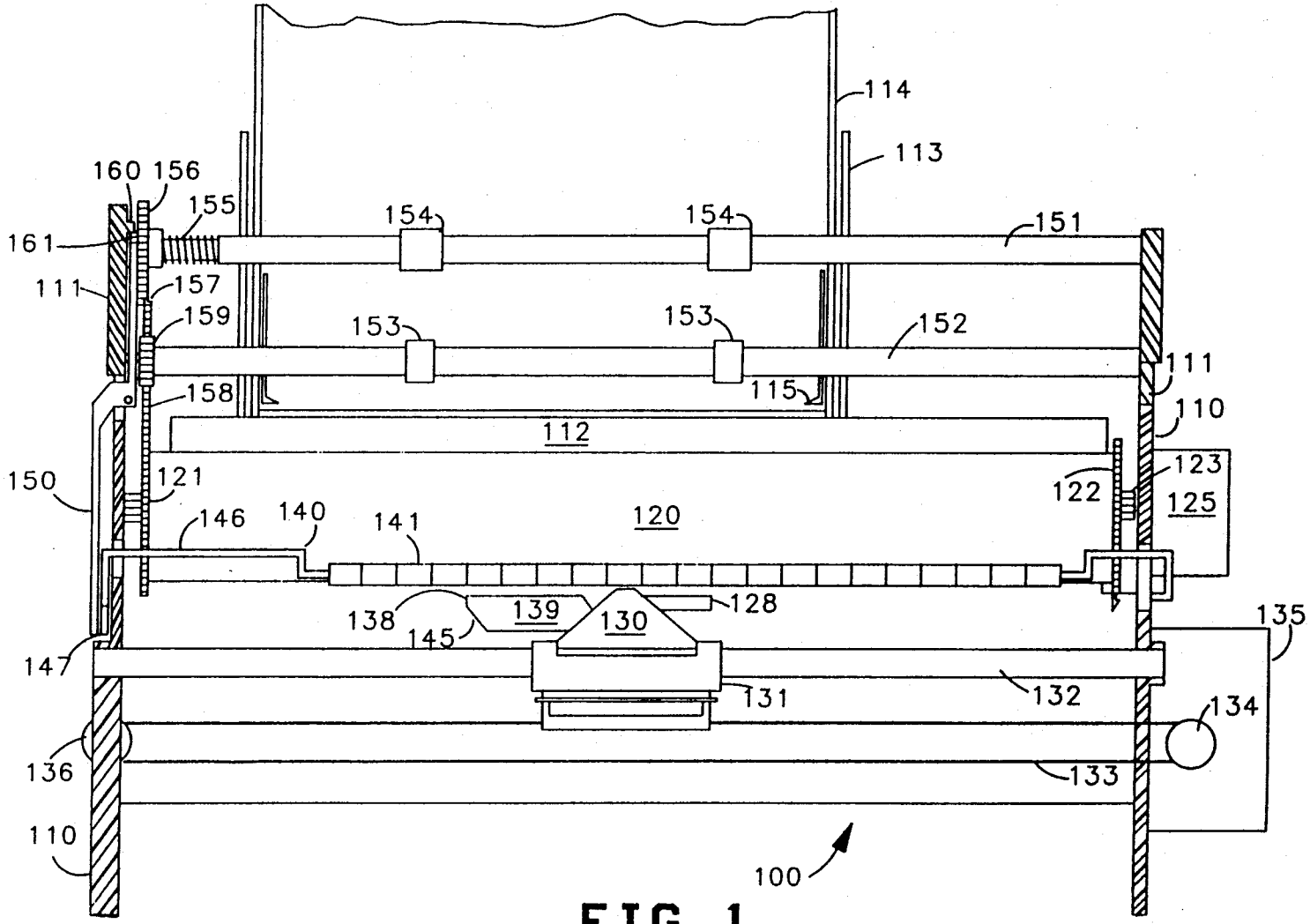
FIG. 1 is a top view of the preferred embodiment of the present invention.
Figure 2:
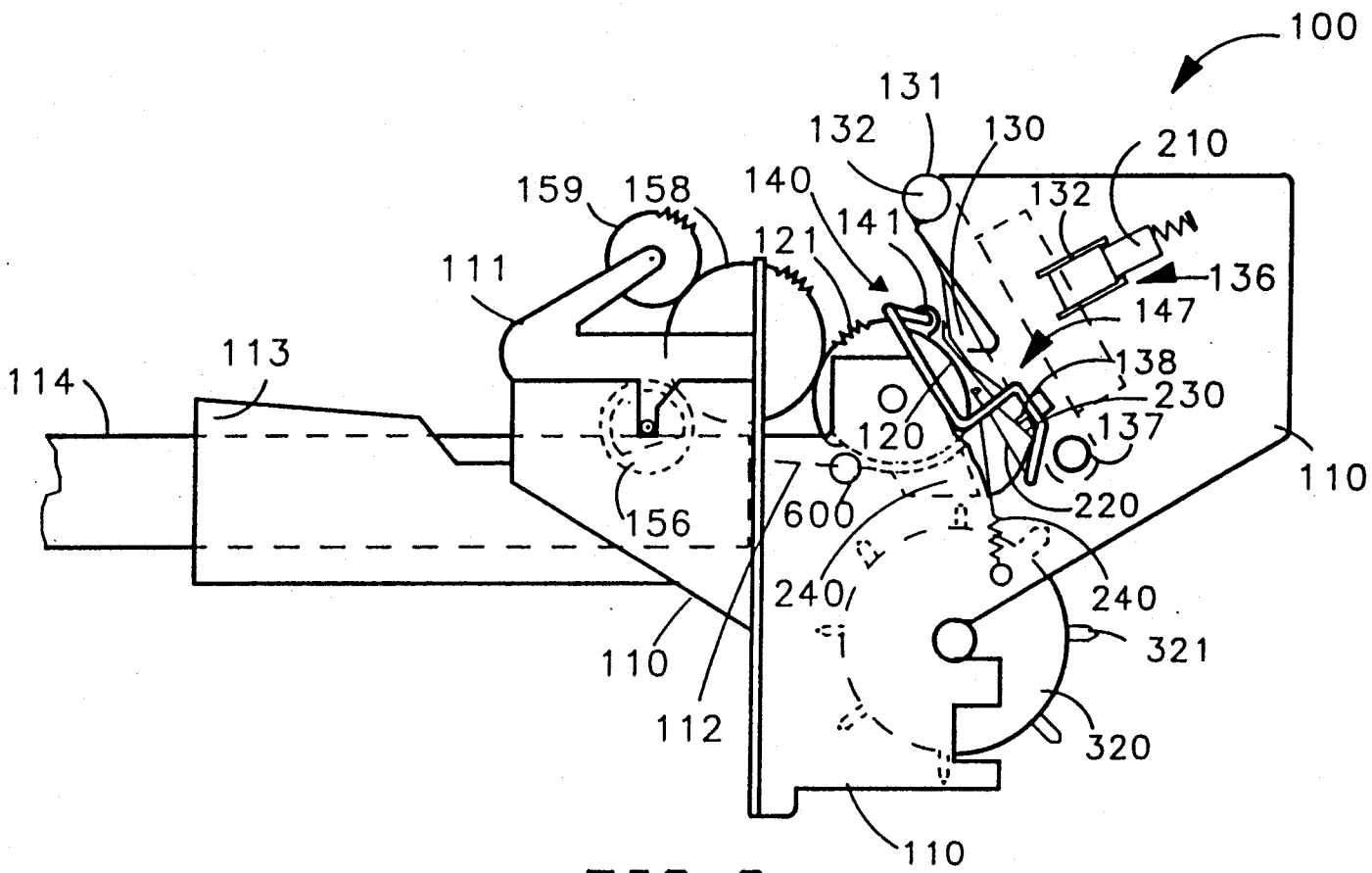
FIG. 2 is a side view of the preferred embodiment of the present invention.
Figure 8:
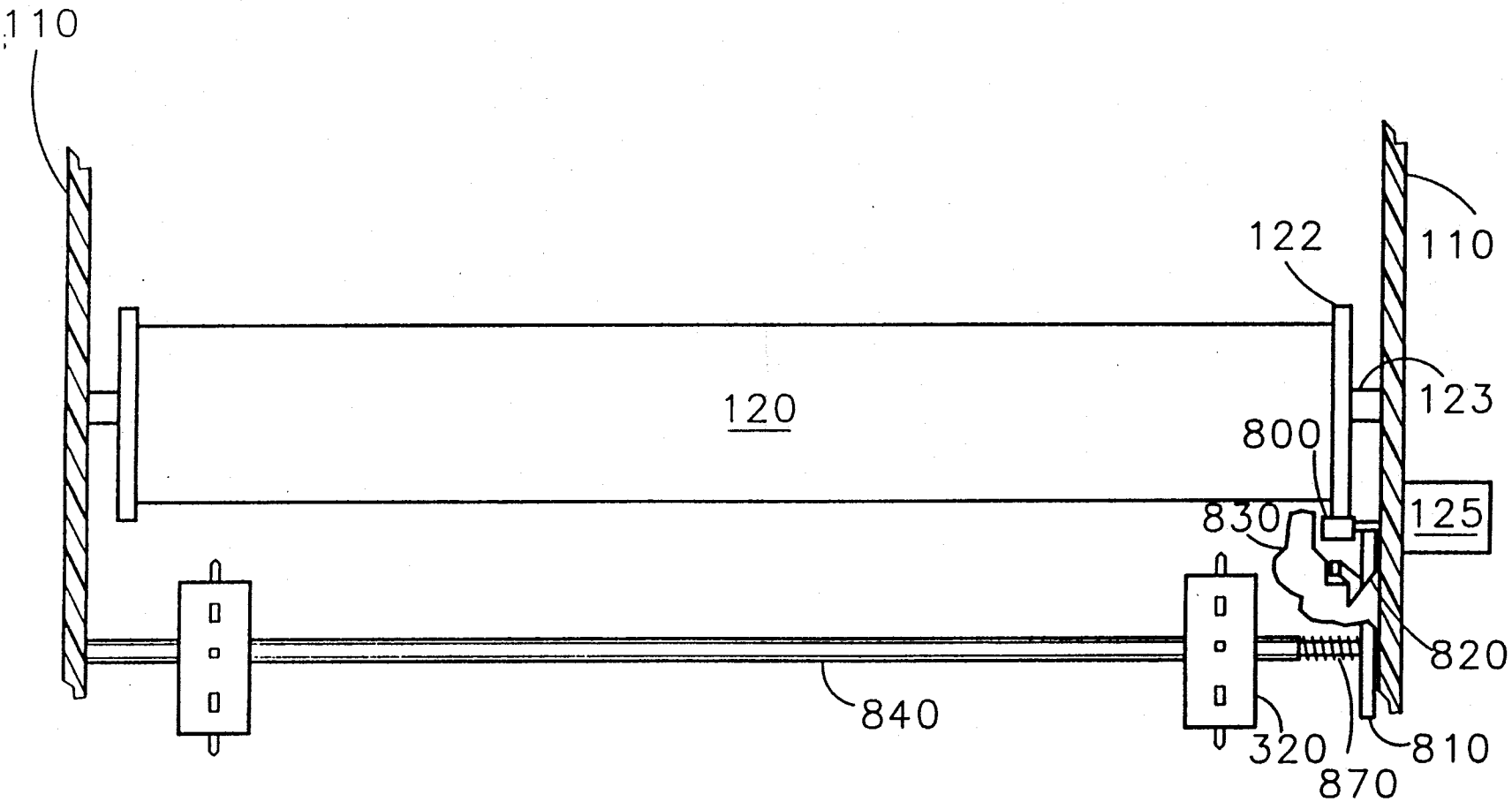
FIG. 8 is a front view of the preferred embodiment of the present invention.
Figure 11:
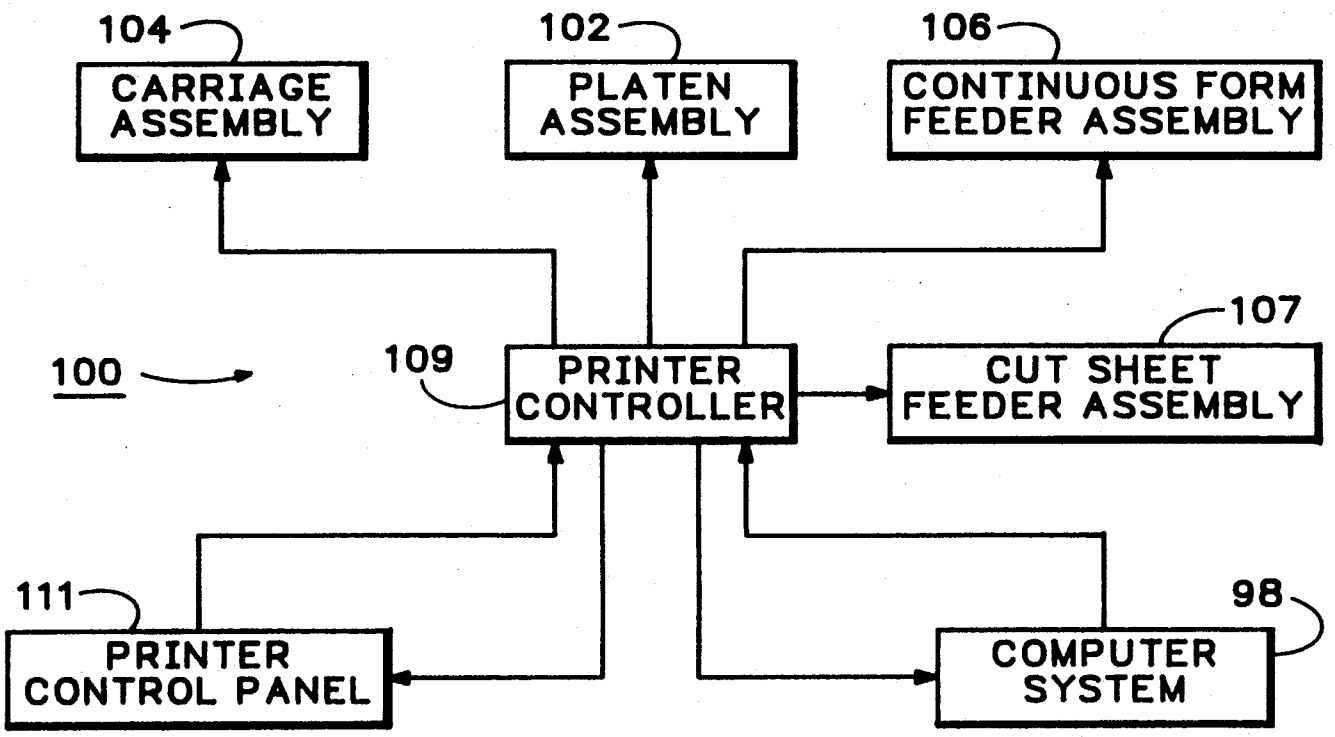
FIG. 11 is a block diagram illustrating a controller which forms a part of the printer of the present invention.

FIG. 1 is a top view of the preferred embodiment of the present invention. FIG. 2 is a side view of the preferred embodiment of the present invention. FIG. 8 is a front view of the preferred embodiment of the present invention. As generally illustrated in FIG. 11, the printer 100 comprises a frame 110, a platen assembly 102, a carriage assembly 104, a continuous form feeder assembly 106, an optional cut sheet feeder assembly 107 and a printer controller 109. The paper feed path is selected by the user through a printer control panel 111 or the user's computer system 98 through a communications interface.

The printer frame 110, and indeed most of the printer parts, are made from injection molded plastic.

The platen assembly 102 accepts paper from one of three paper feed paths and precisely positions the paper to permit the carriage assembly to print on the paper. This printer 100 accepts single cut sheets of paper fed from a paper tray, single cut sheets of paper feed by hand, and continuous forms.

The carriage assembly 104 which mounts in frame 110 holds and positions the print head used to print the characters on the paper. Any type of print head, thermal, impact, or ink jet may be used with the present invention. In the preferred embodiment of the present invention, a dot matrix impact type print head having 24 print wires is employed. The carriage assembly 104 also serves to select the paper path which will be used to feed paper into the platen assembly 102 and to control the bail and other parts of the printer. By using the carriage to control the operation of the platen assembly 102, solenoids and expensive motors have been eliminated thereby reducing the cost and improving the reliability of the printer.

The continuous form feeder assembly 106 accepts and holds continuous forms and transfers those forms to the platen assembly 102 when the user or the user's computer system 98 selects continuous forms.

The cut sheet feeder assembly 107 accepts and holds cut sheets of paper in a paper tray and transfers one sheet of paper at a time to the platen when the tray feed is selected.

The platen assembly 102 comprises the platen 120, a bail 140, pinch rollers 600 and paper guides 112 and 220. The platen is made of hard rubber. The platen 120 has a gear 121 and 122 located at both ends of the platen 120. Two ribbed spacers 123 are molded with gears 121 and 122. The spacers 123 are used to center the platen 120 in frame 110. The platen is mounted in a manner which permits it to rotate freely. The platen is rotated by the platen motor 125 through a gear hub 800. Pinch rollers 600 are employed to guide the paper around the platen. Two paper guides 112 and 220 are also employed to guide the paper. Both paper guides are made of steel. The paper guide 112 is used to guide single sheets, either fed from a paper tray or by hand, around the bottom of the platen. Continuous forms are directed up from the bottom of the printer as described below. The paper guide 220 holds paper against the platen as the paper approaches the print head 130. A third paper guide 230, attached to the carriage assembly insures that the paper will not catch on the bottom of the print head and jam. The paper then passes under a bail 140.

The bail 140 is made of steel and has rollers 141 which permit the paper to move smoothly between the bail and the platen 120. The bail is mounted in the frame 110 and has a first and second position. The bail 140 is biased into the first position by a spring 240. In the first position the bail is resting against the platen 120. The bail 140 keeps the paper flat against the platen 120 while the printer is printing. In the second position the bail 140 is held away from the platen by a distance which permits paper to be loaded into the printer. This distance must be sufficient to insure that the paper always passes between the bail 140 and the platen 120. The bail is bent at point 146 to prevent the bail from hitting the print head when the print head is in the home position and the bail is in the second position.

The carriage assembly 104 comprises the print head 130, a carriage 131, carriage guides 132 and 137, and a carriage drive subsystem. The print head is firmly mounted to the carriage 131. The carriage mounts on the carriage guides 132 and 137 which are attached to the frame 110. The carriage moves parallel to the platen 120 on the steel guides 132 and 137. The carriage 131 has two novel actuators 139 and 128. Actuator 139 has a flat tip and an angled section 145. The angled section is at approximately 33 degrees from the flat tip. The actuator 128 has a flat tip and a smooth top. The operation of the actuators will be described below.

The carriage drive subsystem comprises a motor 135, hubs 134 and 135 and a belt 133. The belt is driven by a hub 134 attached to the motor 135. The other end of the belt is supported by hub 136 and kept under tension by a wedge and spring mechanism 210.

The continuous form feeder assembly 106 comprises two sprockets 320, drive shaft 840, drive gear 810 and a clutch assembly. The sprockets 320 have covers, not shown, which hold the continuous forms against the sprockets 320. The sprockets are mounted on the square drive shaft 840 which may be driven through a sprocket drive gear 810. The sprocket drive gear 810 has a first and second position. In first position the continuous form assembly is driven by the platen motor 125 through hub 800. In the second position the continuous form assembly is disengaged from the platen motor 125. The drive gear 810 is biased into the second position by a spring 870. The drive gear 810 is moved from the second position to the first position by the clutch assembly. The clutch assembly comprises a clutch arm 820 and a spring 860. One end of the clutch arm 820 has a Y shape which contacts drive gear 810. The other end of the clutch arm 820 rests in slot 830 of the frame 110 and is held in the slot by the spring 860. The spring is shown in FIG. 9A.

The cut sheet feeder assembly 107 comprises subframe 111, a cut sheet paper tray 114, idler gear 158, a sheet feeder, and an output feeder. The subframe attaches to the frame 110. The idler gear 158 is rotatably mounted to the subframe 111. The paper tray 114 mounts in a printer tray support 113 molded into the frame 110. The sheet feeder comprises a drive rod 151 which is mounted in a bearing in subframe 111, two wheels 154 and a clutch assembly. The clutch assembly comprise a gear 156, a spring 155 and a clutch arm 150. The drive rod 151 is driven by gear 156 which is held against the subframe 111 by spring 155. The gear 156 is driven by the platen drive motor 125 through gear 158 and the platen gear 121. Two D shaped rubber wheels 154 are mounted to the drive rod 151. The rubber wheels are positioned so that they make contact with the top sheet of paper in the paper feeder tray 114. A clutch arm 150 having a Y shaped end rests against the gear 156 and passes through a hole in the frame 110. The clutch arm is mounted on a pivot which is attached to the subframe 111. The output feeder comprises a drive rod 152 which is mounted in a bearing in subframe 111. The drive rod 152 is driven by gear 159 through gear 158 and platen gear 121 from the platen drive motor 125. Two rubber wheels 153 are mounted to the drive rod 152 and assist the paper as it moves off the platen 120 into an output tray which is a shelf in the case of the printer.

The cut sheet feeder is optional and may be removed by disconnecting subframe 111 from frame 110 and removing the paper tray 114. This permits even a further reduction in cost if desired.

Figure 10A:
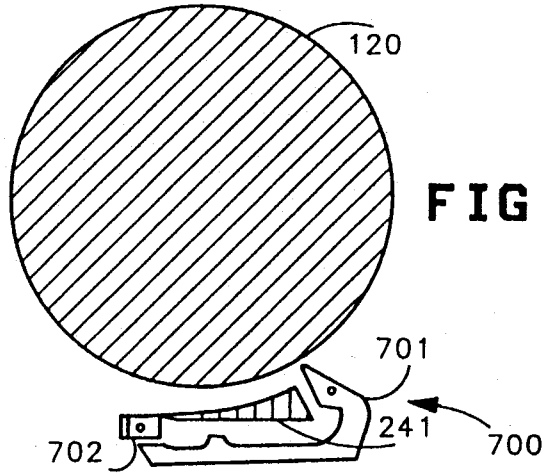
FIG. 10A, FIG. 10B and FIG. 10C illustrate a paper sensor employed in the preferred embodiment of the present invention.
Figure 10B:
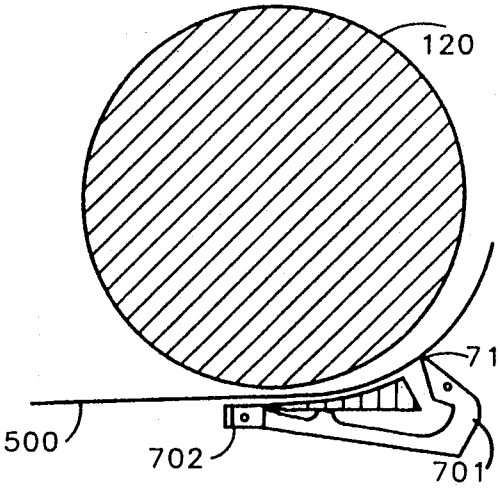
Figure 10C:
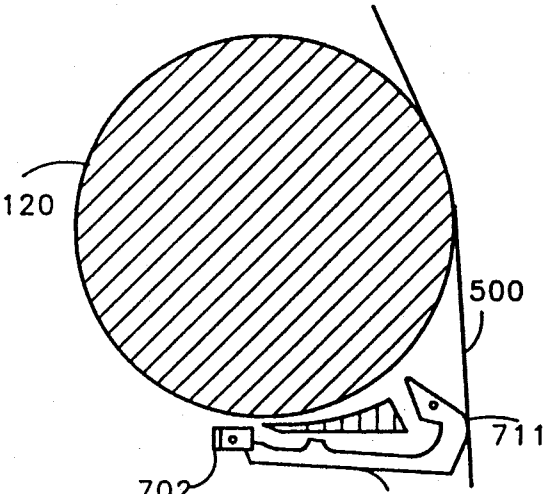

FIG. 10A, FIG. 10B and FIG. 10C describe a paper sensor employed in the preferred embodiment of the present invention. The paper sensor 700 comprises a detector arm 701 pivotally mounted below the platen 120 in a slot in the structural frame member 240. The arm 701 swings freely and, at the end of its travel, breaks a light beam in optical detector 702. The paper sensor is capable of detecting either cut sheets of paper fed from the back of the printer, or continuous forms fed from underneath the printer. FIG. 10A illustrates the paper sensor 700 without any paper present. The arm 701 swings down beneath the light beam of the optical detector 702. In this position, the arm 701 comes into close proximity, but does not touch, the platen 120. FIG. 10B illustrates the paper sensor 700 with a cut sheet of paper 500 present. The cut sheet of paper strikes the top 710 of arm 701 as it curls away from the platen 120. The arm 701 breaks the light beam in the optical detector indicating paper is present. FIG. 10C illustrates the paper sensor 700 with continuous forms. The continuous forms 500 are fed from the bottom of the printer through the sprockets 310 and up toward the platen 120. As the paper passes point 711 on the arm 701, the arm is pushed down and breaks the light beam in the optical detector. In this manner, one paper sensor is capable of detecting paper coming from any paper path.

The printer operates as follows, depending on the type of paper selected. The preferred embodiment of the present invention accepts cut sheets of paper fed either by hand or from a paper tray and continuous forms alternately under the control of the printer controller 109 as selected by the user or the user's computer system 98.

Figure 3:
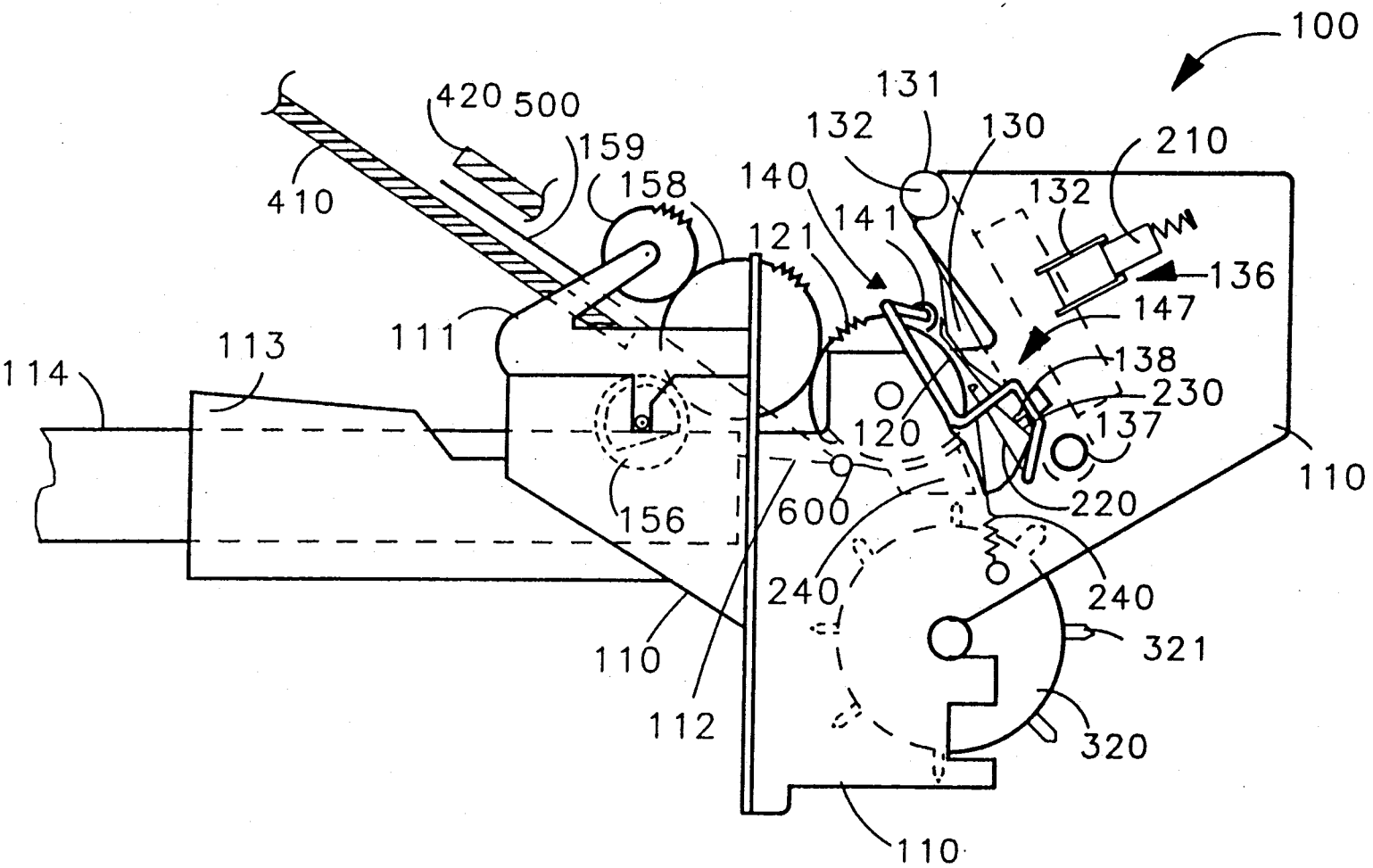
FIG. 3 is a side view of the preferred embodiment of the present invention illustrating a single cut sheet of paper loaded by hand.

Often in office operations it is extremely useful to be able to load a single sheet of paper, usually letterhead stationary, into the printer. FIG. 3 is a side view of the present invention having a single cut sheet of paper loaded by hand. In the preferred embodiment of the present invention, a single sheet of paper may be loaded by placing the sheet of paper through a slot of the printer case (not shown) between an alignment tray 410 and the output tray 420 until it strikes the platen 120. The user then presses a line feed switch on the printer control panel which causes the platen to begin to rotate. The sheet of paper then trips the paper sensor. Once the paper 500 is detected, the printer automatically loads the sheet of paper. The first step in loading the paper is to position the paper around the platen 120. The printer controller 109 continues rotating the platen and thereby feeding the paper between the platen 120 and the frame member 240, underneath guide 220 and around to immediately in front of the print head 130. The top printable line of the paper, approximately one-sixth of an inch below the top of the paper, is aligned beneath the print head 130 and the printer begins printing. The exact position of the paper is determined by the printer controller 109 from when the paper passed the paper sensor and the number of revolutions of the platen drive motor 125. Depending on the size and spacing of the printer fort selected, the printer will be able to print approximately four lines before the top of the paper runs up against the bail 140. The next step is to lift the bail.

Figure 4B:
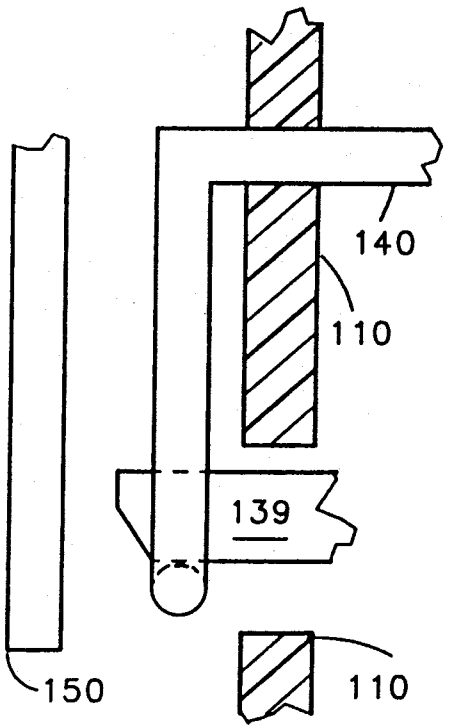
FIG. 4A and FIG. 4B illustrate the operation of the bail lift mechanism.
Figure 4A:
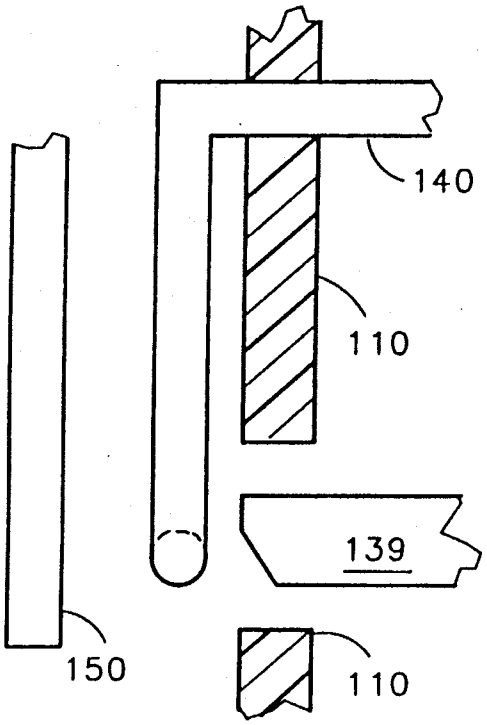

FIG. 4A and FIG. 4B illustrate the operation of the bail lift mechanism. FIG. 4A shows the actuator 139 located on the carriage 131 with the carriage 131 in the home position. In this position, the print head 130 is aligned with the first printable column on the paper. This position is referred to as the home position. To lift the bail, the carriage motor moves the carriage 131 past the home thereby driving the wedge position against the side of bail 140 and forcing the bail away from the platen 120. This does not affect the printing operation of the printer since the printer will not need to print left of the first printable column on the paper. FIG. 4B illustrates the lifted bail 150.

The bail lift procedure is as follows: the printer controller 109 backs the paper down approximately four lines, lifts the bail as described above, and advances the paper approximately five lines. The bail is then released by moving the carriage 131 back to the home position thereby moving the actuator 139 away from the bail and allowing the spring 240 to move the bail back against the platen 120.

The printer controller 109 then continues to print on the paper until the last printable line of the printer is reached. The last printable line is defined to be approximately one-quarter inch from the bottom of the sheet of paper. The single sheet of paper is then moved into the output tray of the printer using the platen drive motor to rotate the paper around the platen 120 until it is free of the platen 140 and helped into the output tray by the output feeder.

Although occasionally hand feeding a sheet of stationary is acceptable, more often office operations will use cut sheets of paper, for example, a large mailing of form letters. In these situations, it would be convenient to feed cut sheets of paper automatically. In the preferred embodiment of the present invention, cut sheets of paper may be loaded into the paper tray 114 and then installed in the printer in paper tray support 113. The paper tray employed in the preferred embodiment of the present invention is compatible with paper trays commonly used in low cost photocopiers. These paper trays comprise a plastic tray having paper separators 115, usually made of stamped sheet metal. The cut sheets of paper are typically held against the paper separators 115 by a steel spring. The paper separators typically have triangularly shaped ends which are designed to separate the top sheet of paper from the remaining sheets of paper in the paper feed tray when the top sheet is pushed parallel to the paper feed tray.

Figure 6:
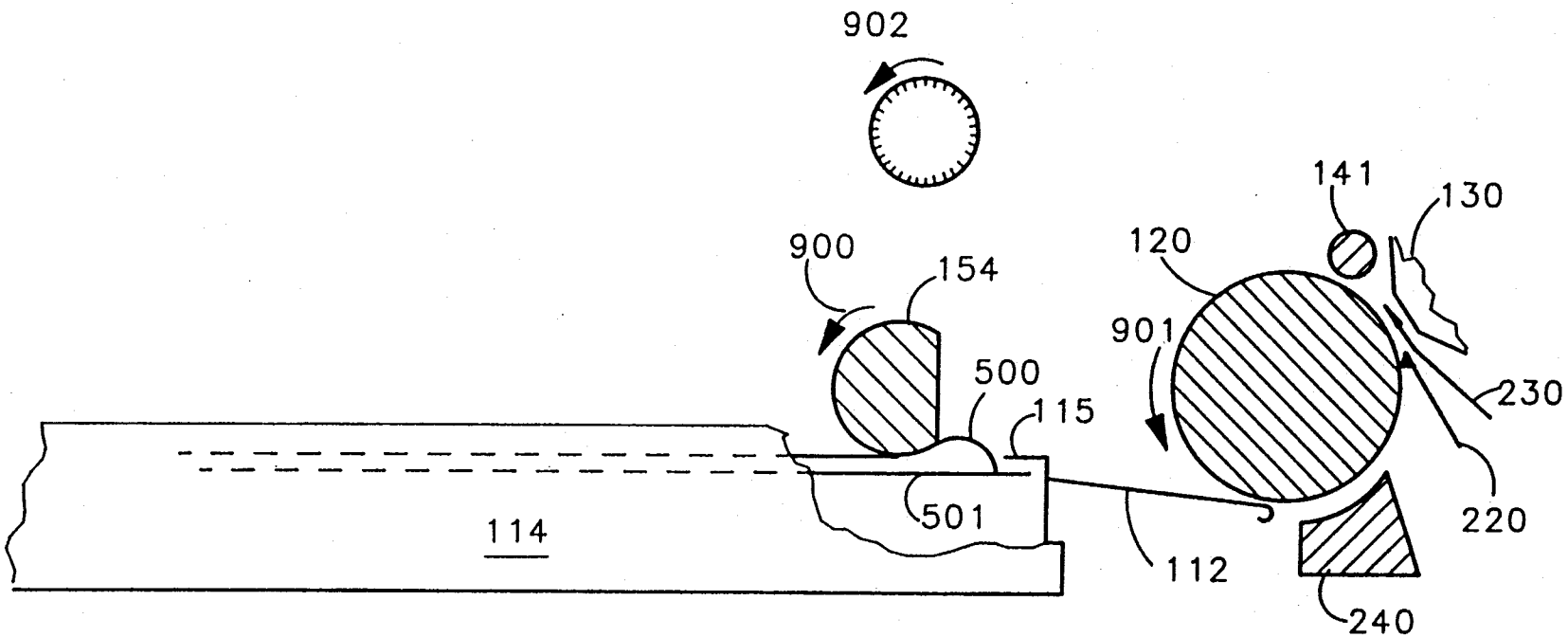
FIG. 6 is a side view of the preferred embodiment of the present invention illustrating a single cut sheet loaded from a paper tray containing cut sheets of paper.

The preferred embodiment of the present invention employs a novel means for supplying the force required to separate a single sheet of paper away from the paper tray and feed that sheet of paper into the printer. FIG. 6 is a side view of the present invention illustrating a single cut sheet of paper 500 being loaded from a paper tray containing cut sheets of paper. As shown in FIG. 2, the D shaped rubber wheels are normally held in a position with the flat portions of the wheels parallel to the tray 114. This permits the tray 114 to be easily inserted and removed from the printer. When a cut sheet is to be fed from the tray 114, the wheels 154 are rotated until the front portion of the wheel comes into contact with the cut sheets of paper held in the paper tray. As the wheels 154 continue to rotate the top sheet of paper 500 begins to buckle, as shown in FIG. 6, separating itself from the remaining stack of paper in the paper tray 114. As the wheel 154 continues to rotate, the top sheet of paper 500 will spring around the paper separators 115 and feed along the paper guide 112. The paper 500 finally is driven between the guide 112 and the platen 120. The paper 500 is driven by the wheels 154 approximately twenty percent faster than the platen 120 accepts the paper 500. This insures that the paper will feed squarely into the platen and not at an angle which would cause the paper to be misaligned with the printer. Once the paper 500 has made firm contact with the platen 120, the platen begins to move the paper. This is designed to correspond to approximately the time that the trailing edge of the D shaped wheels 154 lifts off the paper 500. The paper is then free from wheels 154 and the platen 120 draws the paper into the platen assembly.

Operation from this point is identical to the operation with the hand fed sheet of paper. The platen drive motor 125 is used to rotate the platen and thereby feed the paper under guide 112, between the platen 120 and the frame member 240, underneath guide 220 and around to immediately in front of the print head 130. The top printable portion of the paper is aligned beneath the print head 130 and the printer begins printing. The exact position of the paper is determined by the printer controller 109 from when the paper passed the paper sensor and the number of revolutions of the platen drive motor 125. Depending on the size and spacing of the print font selected, the printer will be able to print approximately four lines before the top of the paper runs up against the bail 140. The next step is to lift the bail.

The bail lift procedure is as follows: the printer controller 109 backs the paper down approximately four lines, lifts the bail as described above, advances the paper approximately five lines and releases the bail.

The printer controller 109 then continues to print on the sheet of paper until the last printable line of the printer is reached. The single sheet of paper is then moved into the output tray of the printer and the next cut sheet of paper is loaded.

Figure 7B:
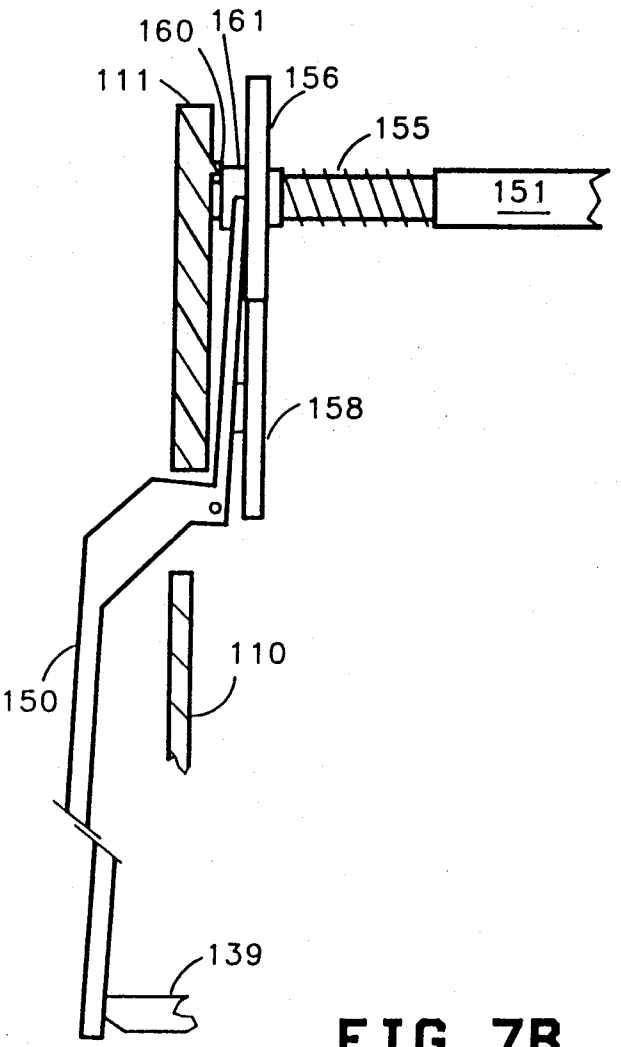
FIG. 7A and FIG. 7B illustrate the clutch mechanism employed to drive the sheet feeder.
Figure 7A:
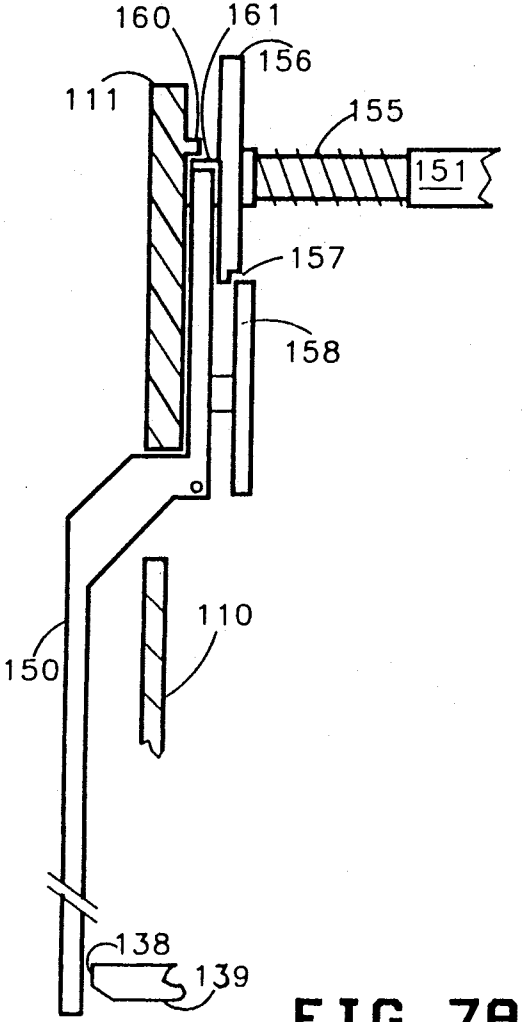

Since one object of this invention is low cost, a low cost means of driving the sheet feeder is required. The preferred embodiment of the present invention feeds cut sheets of paper without employing separate drive motors or solenoids. FIG. 7A and FIG. 7B illustrate the mechanism employed to drive the sheet feeder. FIG. 7A illustrates the sheet feeder drive mechanism in the normal operating position for the printer. In the normal operating position, the gear 158 is disengaged from the sheet feeder. There are two aspects to keeping the sheet feeder disengaged. First, the drive gear 156 has a flat portion on the outside hub 161 of the gear. This flat portion has a corresponding rib 160 in the subframe 111. When the drive gear 156 is in the disengaged position, the spring 155 holds the flat portion of the gear 156 against the rib 160 so the gear 156 does not move. Second, in order to insure that the gear does not interfere with the operation of the gear 158 during the normal operation of the printer, a cutout 157 in gear 156 is positioned across from the gear 158. The idler gear 158 drives the output feeder at all times.

FIG. 7B illustrates the printer with the sheet feeder engaged. When it is time to load a sheet of paper from the paper tray 114, the actuator 139 on carriage 131 is driven past the bail lift position and against the clutch arm 150. The clutch arm 150 slides the gear 156 over until the gear 156 is aligned with gear 158 and the hub 161 is clear of rib 160. The platen drive motor is then activated and the platen begins to rotate which in turn drives the cut sheet feeder with its D shaped wheels 154. The cut sheet of paper is then fed into the printer as described above. Once the gear 156 has rotated past the cutout 157, the clutch arm 150 is no longer required and the carriage may be moved to the home position. The cut sheet feeder assembly will then continue to rotate until the flat portion of hub 161 again aligns with the rib 160 and the gear slides over into the disengaged position shown in FIG. 7A.

Figure 5:
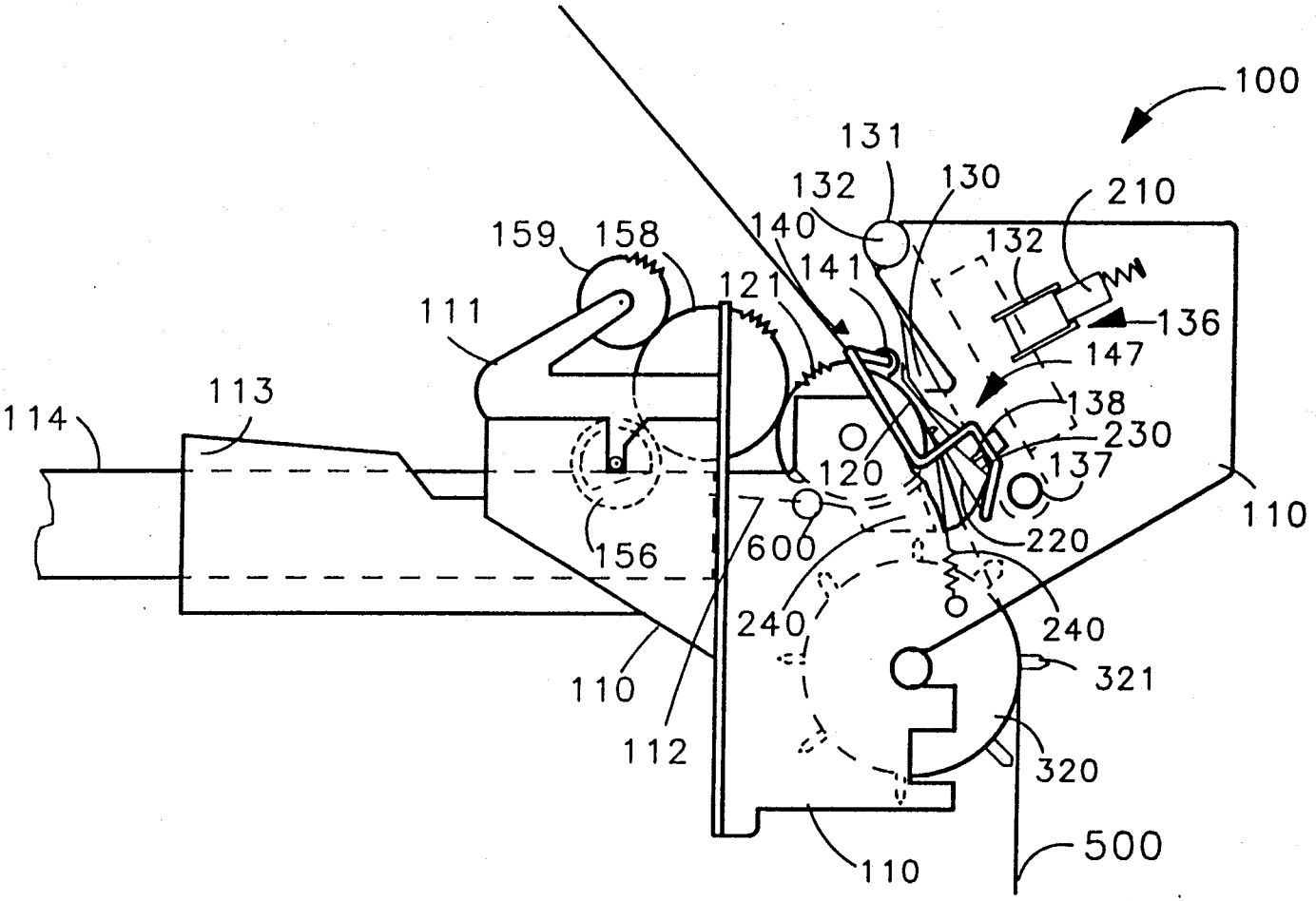
FIG. 5 is a side view of the preferred embodiment of the present invention illustrating a continuous form loaded.

Office operations also often employ continuous printed forms, for example invoices or order forms, in their daily operations. FIG. 5 is a side view of the present invention having continuous forms loaded. The continuous forms 500 are fed from the bottom of the printer up through sprockets 320, underneath sheet metal guide 220 and around the platen 120, then under bail 140 and out the top of the printer. A tear off bar is provided on the case of the printer to aid in the separation of one form from the next form. A top of form position is established by counting the number of revolutions of the platen drive motor after the forms have passed the paper sensor. The first printable line is defined as one-sixth inch below the physical top of the form.

A novel feature of the preferred embodiment of the present invention is the printer's ability to load and unload the continuous forms. Once the printer has been printing on continuous form paper, the user or the user's computer system may select either hand or tray fed cut sheets of paper be used. The printer controller 109 retracts the continuous form paper from the platen employing the continuous form drive. The continuous forms are retracted until the continuous forms are out of the paper path for cut sheets of paper. The printer controller 109 then disengages the continuous form drive as described below. When the user or user's computer again wishes to use the forms, the printer clears the paper path of any cut sheets of paper. The printer controller 109 re-engages the continuous form feed and advances the forms into the printer where paper guides 220 and frame member 240 direct the forms against the platen. The forms trip the paper sensor as described above and the forms are positioned in front of the print head. Again, the printer controller 109 counts the revolutions of the platen drive motor since the paper passed the paper sensor to determine the position of the paper and the top of form.

Figure 9B:
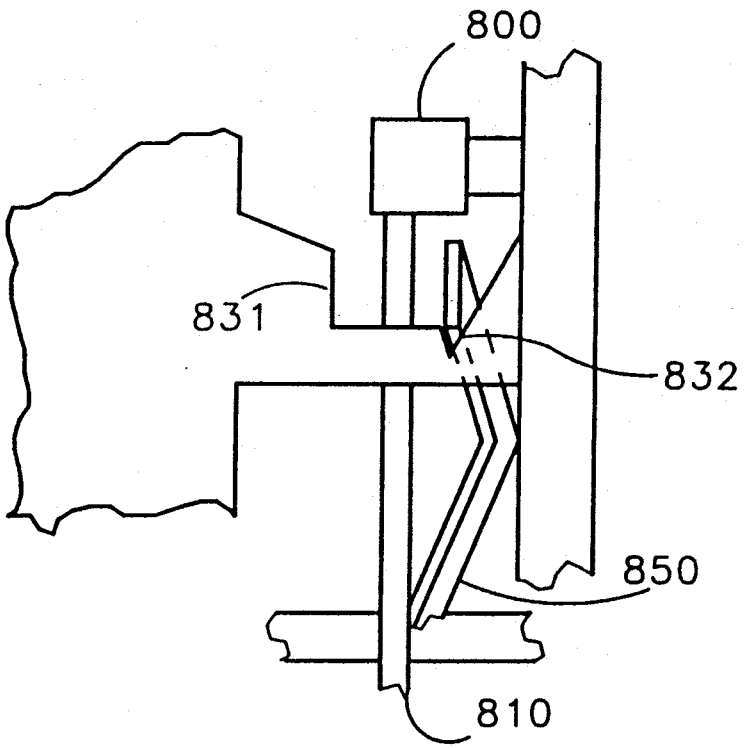
FIG. 9A and FIG. 9B illustrate the clutch mechanism employed to engage and disengage the continuous paper feeder.
Figure 9A:
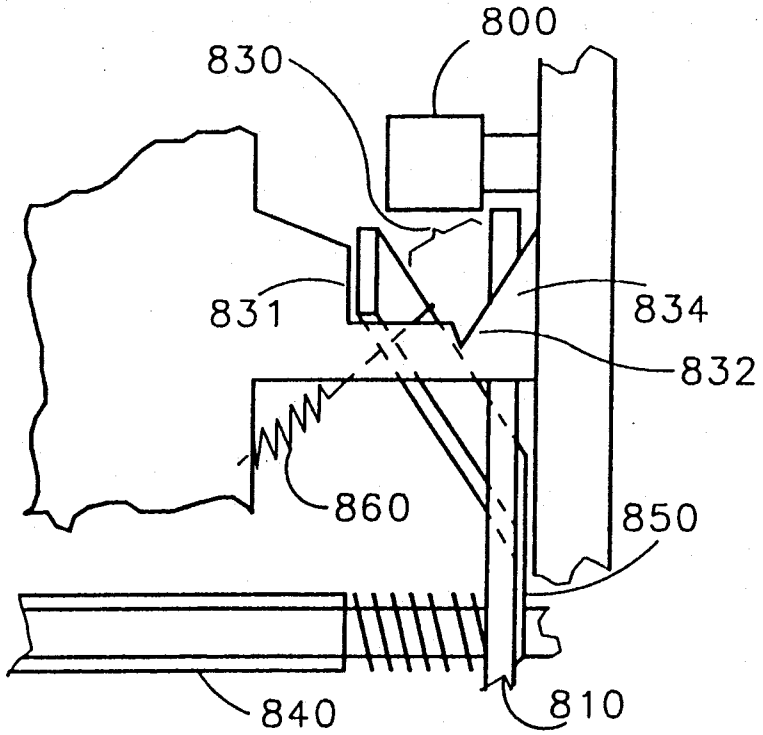

FIG. 9A and FIG. 9B illustrate the clutch mechanism employed to engage and disengage the continuous form feeder. In FIG. 9A the sprocket drive gear 810 is disengaged from the hub 800 and the platen is free to operate independently of the continuous form feeder. In FIG. 9B the sprocket drive gear 810 is engaged with the hub 800 and both the sprockets 320 and the platen 120 are driven by the platen motor 125. The sprocket drive gear 810 is moved from the disengaged state to the engage state by clutch arm 820. The clutch arm is in turn driven by actuator 128 mounted to the carriage 131. The clutch arm operates in slot 830. The slot has two resting positions 831 and 832 for the clutch arm 820. In the first position 831, the sprocket drive gear is disengaged from the drive hub. In the second position 832, the sprocket drive gear is engaging the drive hub. The actuator engages the clutch arm 820 just past the last printing position. The clutch arm is moved from the first position to the second position by the actuator sliding the arm along the bottom of the slot 830 to position 832. Spring 860 latches the clutch arm into position 832 by pulling and holding the arm into the notch. To move from the second position 832 to the first position, the actuator pushes the clutch arm up the ramp 834. This causes the clutch arm to ride over the top of the actuator 128 and then snap back to the end of slot 830. When the carriage returns to a printing position, the clutch arm slides into the first position 831. In this way the carriage may be used to engage and disengage the continuous paper feed.

Additional applications of the present invention are readily apparent to those skilled in the art.

The means for controlling printing of a series of forms in a printer is described in a co-pending patent application Ser. No. 335,003, filed on Apr. 7, 1989, and entitled MEANS FOR CONTROLLING PRINTING OF A SERIES OF FORMS IN A PRINTER". This co-pending application describes the automatic positioning of the printhead at the top of the page of the continuous print forms.

We claim:

1. A serial printer for printing on a print medium, comprising:

a frame;

a platen mounted to said frame;

a platen drive mechanism mechanically associated with said platen for advancing print medium across said platen;

a carriage including a printhead mechanically associated with said platen to move in a print path parallel to said platen between a first position and a second position;

a carriage drive mechanism mechanically associated with said carriage for driving said carriage parallel to said platen;

at least one subsystem (apart from said platen drive mechanism) mechanically associated with said carriage to be actuated by said carriage when driven beyond said print path; and a printer controller communicatively linked to said carriage drive mechanism and programmed to control said carriage beyond said print path to actuate said subsystem at preselected times.

2. A printer according to claim 1 wherein said subsystem comprises:

a plurality of feeder mechanisms for selectively feeding one of a plurality of print media to said platen drive mechanism; and;

a clutch mechanism mechanically associated with said feeder mechanisms and said carriage for selecting between feeder mechanisms upon actuation by said carriage when said carriage is beyond said print path;

wherein said printer controller is programmed to control said carriage beyond said print path to actuate said clutch mechanism at preselected times.

3. A printer according to claim 2 wherein said plurality of feeder mechanisms include a feeder mechanism for continuous forms and a feeder mechanism for cut sheets.

4. a printer according to claim 1 wherein said subsystem comprises:

a bail mounted to the frame and having a first position in which it is proximate the platen and a second position in which it is away from the platen; and bail lift means mechanically associated with said bail and said carriage for urging said bail between said first and second positions upon engagement with said carriage when said carriage is beyond said print path to actuate said bail lift means at preselected times.

* * * * *